US008747126B2

(12) United States Patent
Corbett et al.

(10) Patent No.: US 8,747,126 B2
(45) Date of Patent: Jun. 10, 2014

(54) UNIVERSAL GROUND ADAPTER FOR MARINE CABLES

(71) Applicants: Blaise L. Corbett, King George, VA (US); David J. Griffiths, King George, VA (US)

(72) Inventors: Blaise L. Corbett, King George, VA (US); David J. Griffiths, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/051,385

(22) Filed: Oct. 10, 2013

(65) Prior Publication Data

US 2014/0041938 A1 Feb. 13, 2014

Related U.S. Application Data

(63) Continuation-in-part of application No. 13/385,470, filed on Jan. 26, 2012, now Pat. No. 8,562,361.

(60) Provisional application No. 61/628,298, filed on Oct. 11, 2011.

(51) Int. Cl.
*H01R 4/66* (2006.01)

(52) U.S. Cl.
USPC ..... 439/98

(58) Field of Classification Search
USPC ..... 439/100, 862, 860, 868, 883, 609, 578, 439/389, 92, 98
See application file for complete search history.

(56) References Cited

U.S. PATENT DOCUMENTS

| | | | | |
|---|---|---|---|---|
| 4,022,966 | A | 5/1977 | Gajajiva | 174/653 |
| 4,273,405 | A | 6/1981 | Law | 439/462 |
| 4,515,991 | A | 5/1985 | Hutchison | 174/654 |
| 4,687,263 | A | 8/1987 | Cosmos et al. | 439/108 |
| 4,772,212 | A | 9/1988 | Sotolongo | 439/98 |
| 4,904,826 | A | 2/1990 | Dixon | 174/35 |
| 5,308,250 | A | 5/1994 | Walz | 439/63 |
| 5,477,159 | A | 12/1995 | Hamling | 324/754 |
| 5,691,506 | A * | 11/1997 | Miyazaki et al. | 174/652 |

(Continued)

OTHER PUBLICATIONS

Glenair Installation Instructions—Threaded-Stem Stuffing Tube. http://www.airmartechnology.com/uploads/installguide/17-423-01.pdf.

(Continued)

*Primary Examiner* — Neil Abrams
*Assistant Examiner* — Phuongchi T Nguyen
(74) *Attorney, Agent, or Firm* — Gerhard W. Thielman, Esq.

(57) ABSTRACT

An adapter is provided for electrically connecting an interior surface of a conduit and an external surface of a cable. The adapter includes a flat strip extending longitudinally from first to second ends with first and second transverse edges and composed of an electrically conductive and mechanically flexible material. The strip includes a longitudinal ribbon that forms a ring for wrapping around the cable by curling the first and second ends together in a direction transverse to the sheet, and a plurality of first and second incisions from the transverse edges towards the ribbon, the incisions being disposed at respective intervals that correspond to a longitudinally regular pattern. The first incisions form tapering tabs for bending in the direction transverse to the sheet to produce petals that extend radially inward from the ring to engage the cable. The second incisions form peripheral tabs for bending in an opposite direction transverse to the sheet to produce flanges that extend radially outward from the ring to engage the conduit.

10 Claims, 8 Drawing Sheets

(56) References Cited

U.S. PATENT DOCUMENTS

| | | | | |
|---|---|---|---|---|
| 6,027,349 | A | 2/2000 | Chang | 439/101 |
| 6,062,910 | A | 5/2000 | Braquet et al. | 439/620 |
| 6,406,330 | B2 | 6/2002 | Bruce | 439/607.19 |
| 6,468,100 | B1 | 10/2002 | Meyer et al. | 439/320 |
| 6,683,773 | B2 | 1/2004 | Montena | 361/119 |
| 7,942,679 | B1 | 5/2011 | Gretz | 439/108 |
| 8,299,362 | B2 | 10/2012 | Vaughan | 174/72 A |
| 8,337,229 | B2 * | 12/2012 | Montena | 439/322 |
| 8,506,325 | B2 * | 8/2013 | Malloy et al. | 439/578 |
| 8,506,326 | B2 * | 8/2013 | Purdy | 439/578 |
| 8,529,279 | B2 * | 9/2013 | Montena | 439/322 |
| 8,550,835 | B2 * | 10/2013 | Montena | 439/322 |
| 8,562,361 | B2 | 10/2013 | Corbett et al. | 489/389 |

OTHER PUBLICATIONS

MIL-S-24235/2C(SH), Military Specification Sheet—Stuffing Tube, Dec. 28, 1992. http://domequipment.com/milspecs/pdf/24235-2C.pdf.

Research Tool & Die Catalog Numbering System Stuffing Tubes. http://www.rtnd.com/catalog/4-8.pdf.

Activity Report Cable Shield Ground Adaptor Resistance to Indirect Lightning Effects Test, Jun. 2013.

MIL-S-24235/2C(SH) Military Specification Sheet—Stuffing Tube, 1992. http://domequipment.com/milspecs/pdf/24235-2C.pdf.

Swage Type, Stuffing Tubes, Shipboard Electric Supply. http://www.shipboardelectrical.com/swagetubes.html.

* cited by examiner

UNIVERSAL GROUND ADAPTER FOR MARINE CABLES

CROSS REFERENCE TO RELATED APPLICATION

The invention is a Continuation-in-Part, claims priority to and incorporates by reference in its entirety U.S. patent application Ser. No. 13/385,470 filed Jan. 26, 2012, published as U.S. Patent Application Publication 2013/0090004 and assigned Navy Case 101421, which claims the benefit of priority, pursuant to 35 U.S.C. §119, the benefit of priority from provisional application 61/628,298, with a filing date of Oct. 11, 2011.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ground adapters for electrical cables, especially those used aboard marine vessels and platforms. In particular, the invention relates to embodiments for low-impedance designs of a cable shield ground adapter (CSGA).

The United States Navy currently employs two technologies to provide electromagnetic (EM) protection from coupling to topside (i.e., above-deck) cables; conduit which provides an overall EM shield to cables placed within the conduit, and shielded cables with CSGAs used as termination connectors. Both technologies are viable but components used are expensive and difficult to maintain. The proposed CSGA embodiments deal almost exclusively with shielded cables and conduits. These are not explicitly described herein with respect to further applications, although the technology could be applied to the conduit shell whether flexible or rigid.

Conventional CSGA designs have been proven to be effective at grounding cable shielding when properly installed, achieving grounding effectiveness measures that exceed 80 decibels (dB), but are not easily repaired. The conventional designs are designed for use with swage tubes, also known as stuffing tubes. Specification requirements for the swage tube are provided in MIL-S-21239. Commonly utilized CSGA designs include Glenair® CSGA from Glenair Inc. of Glendale, Calif. and SkinTop® available from LAPP Group Inc. of Florham Park, N.J. The background section of parent application publication 2013/0090004 includes further details about the conventional configurations.

SUMMARY

Conventional electrical ground adapters yield disadvantages addressed by various exemplary embodiments of the present invention. In particular, various exemplary embodiments provide an electrical grounding adapter within a conduit sealing assembly for electrically and environmentally shielding an electric cable. Various exemplary embodiments provide an adapter for electrically connecting an interior surface of a conduit and an external surface of a cable. The adapter includes a flat strip extending longitudinally from first to second ends with first and second transverse edges and composed of an electrically conductive and mechanically flexible material.

In exemplary embodiments, the strip includes a longitudinal ribbon that forms a ring for wrapping around the cable by curling the first and second ends together in a direction transverse to the sheet, and a plurality of first and second incisions from the transverse edges towards the ribbon, the incisions being disposed at respective intervals that correspond to a longitudinally regular pattern. The first incisions form tapering tabs for bending in the direction transverse to the sheet to produce petals that extend radially inward from the ring to engage the cable. The second incisions form peripheral tabs for bending in an opposite direction transverse to the sheet to produce flanges that extend radially outward from the ring to engage the conduit.

The assembly includes a conduit having a receiving end through which the cable passes axially; a lower seal that inserts into the receiving end; a gland boss that inserts into the receiving end; an external seal that inserts into the boss and extends axially outward from the receiving end; and the grounding adapter disposed between the internal and external seals.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION OF EMBODIMENTS

Figure 1A:
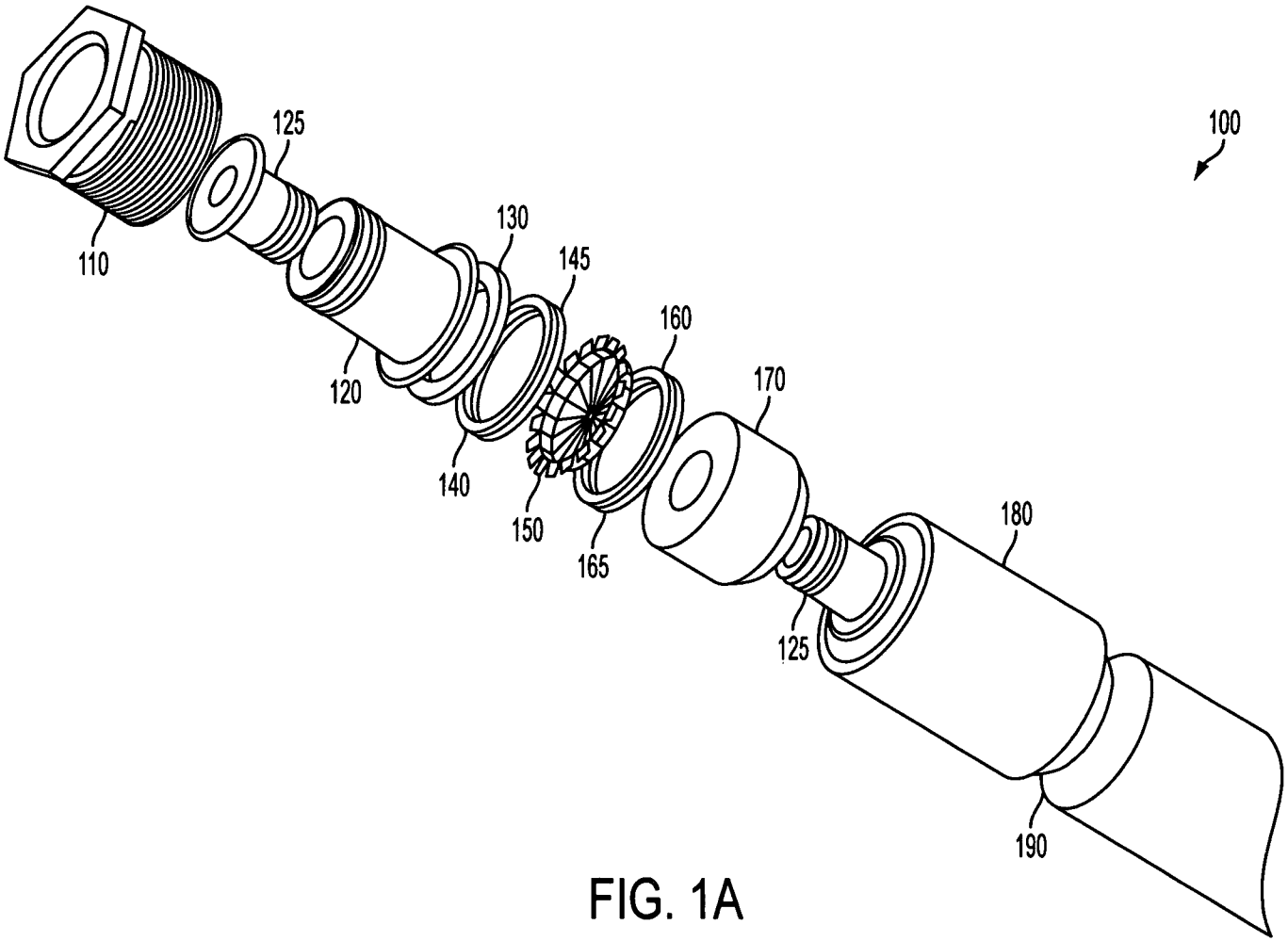
FIGS. 1A and 1B are exploded perspective views of an exemplary ground adapter assembly.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments related to the invention were developed for the purposes of providing a Cable Shield Ground Adapter (CSGA) with the following characteristics important for use in marine environments and in particular shipboard environments:

- Environmental sealing from both interior and exterior weather conditions.
- Universal Adaptive electrical grounding contact for all sizes of cable or conduit applicable to the maximum interior dimensions of a swage tube whether metric or Society of Automotive Engineers (SAE).
- Universal Adaptive electrical grounding contact for minor variances in the interior diameter of swage (stuffing) tubes due to SAE or metric sizing.
- Better areal contact with the cable shield and inner wall of swage tube.
- Better physical tolerance from pulling or distortion of cable and conduit.
- Simplicity of design.
- Simplicity of installation, repair and replacement.
- At sea component replacement.
- Longer lifetime of grounding components.
- Ability to use broad selection of conductive materials.
- Reduced waste of component materials of common swage tubes.
- Reduced cost of installation and repair.

Patent Application Publication 2013/0090004 describes three designs for CSGAs for maritime utility, notionally referred to as "snowflake", "roll-o-dex" and "lantern" for purposes of description. An activity report: "Cable Shield Ground Adaptor Resistance to Indirect Lighting Effects Test" of June 2013 describes performance of the roll-o-dex and snowflake CSGA configurations of copper and stainless steel, both in D and K sizes, with the snowflake design demonstrating generally better grounding performance. The lantern configuration exhibited structural weakness and was hence not included. The terms "adapter" and "adaptor" are considered synonymous as spelling variants.

Swage stuffing tubes, as military part M24235/17, have several standard sizes as listed at http://www.shipboardelectrical.com/swagetubes.html including a tube body, gland nut and gland ring. The tube body can be stainless steel or aluminum. For purposes of disclosure, sizes B, C, D and K are described herein, although the principles described herein can be extended to additional cable sizes. Respective cable bore diameters for sizes B, C, D and K are Ø0.515 inch ("), Ø0.640", Ø0.750" and Ø1.171 inches (").

The particular dimensions identified herein represent explanatory examples and are not limiting. Thus, other stuffing tube and conduit sizes can be contemplated within the spirit of the claims. MIL-S-24235/2C provides the military standard dimensions for electrical cable packaging, available at http://dornequipment.com/milspecs/pdf/24235-2C.pdf.

For purposes of grounding, an improved design for the CSGA is disclosed herein, combining advantages from the snowflake and roll-o-dex configurations in terms of performance and ease of manufacture. The roll-o-dex and lantern configurations can be produced as a metal ribbon or strip with a repeating pattern, cut to length, the tabs bent inward or outward, and the ends joined together for wrapping around an electrical cable to be grounded.

The snowflake configuration can be produced by cookie-cutter stamping of a circular coupon having an angularly regular pattern. The improved "stetson" or "boater" or "pork-pie" configuration maintains the metal strip with repeating pattern of the roll-o-dex design combined with the denser penetrating contact capability of the snowflake design. The name stetson evokes a short broad-brim hat common at American political conventions, which the disclosed configuration resembles.

Additionally, the disclosure provides for lower and upper annular gaskets to provide environmental seals for the CSGA in the swage tube. The B-size lower gasket has an outer diameter (OD) of Ø0.970" and a bore inner diameter (ID) of Ø0.190" and a height of 0.563". The B-size upper gasket has a base rim of Ø0.996", a stem OD of Ø0.500", a stem ID of Ø0.190" and a height above the rim of 1.000". The C-size lower gasket has an OD of Ø1.090" and bore IDs of alternatively Ø0.397" and Ø0.230", and a height of 0.563". The C-size upper gasket has a base rim of Ø1.040", a stem OD of Ø0.608", stem IDs of alternatively Ø0.397" and Ø0.230", and a height above the rim of 1.000".

The D-size lower gasket has an OD of Ø1.210" and bore IDs of alternatively Ø0.635" and Ø0.474", and a height of 0.583". The D-size upper gasket has a base rim of Ø1.280", a stem OD of Ø0.750", stem IDs of alternatively Ø0.636" and Ø0.474", and a height above the rim of 1.000". The K-size lower gasket has an OD of Ø1.655" and bore IDs of alternatively Ø1.000", Ø0.750" (D insert), Ø0.635" (C insert) and Ø0.500" (B insert), and a height of 1.020". The K-size upper gasket has a base rim of Ø1.040", a stem OD of Ø1.160" (expanding to Ø1.222" at the base), stem IDs of alternatively Ø1.000", Ø0.750", Ø0.635" and Ø0.500" (for accepting smaller size inserts), and a height above the rim of 1.500". While these dimensions are derived for use with commonly available swage tube and cable sizes, artisans of ordinary skill will understood that these dimensions could be adjusted to account for future variants without departing from the scope of the invention.

Figure 1B:
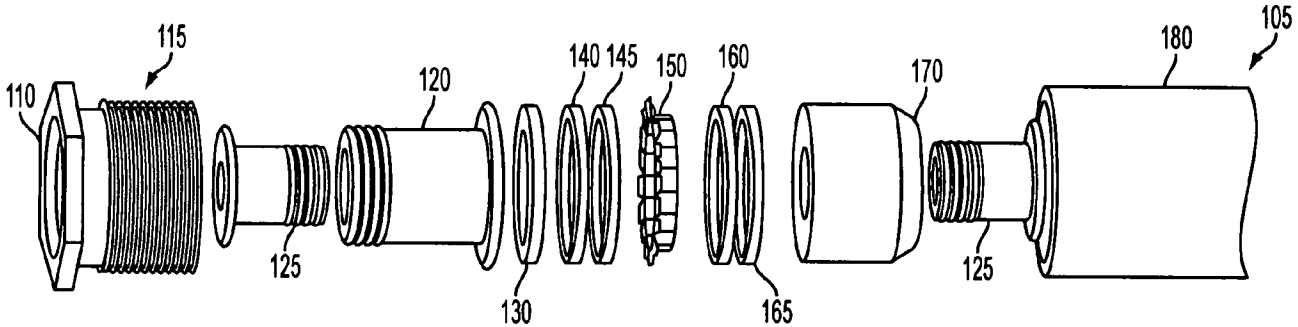

FIGS. 1A and 1B show respective perspective exploded views 100 and 105 of exemplary swage tube components. A gland boss or nut 110 presents an annular access and includes outer threads 115 for installation. The gland nut 110 is typically composed of brass or aluminum. A stuffing upper gasket 120 and an optional insert upper gasket 125 provide an environmental seal for the stuffing tube interior for the access at the gland nut 110. A gland ring 130 constitutes a shim or spacer between the upper gasket 120 and other components in the swage tube 180. The views 100 and 105 show orientation from upstream at the left to downstream at the right in the direction for inserting a cable to be shielded and grounded.

An upper pair of slip rings 140 and 145 provides axial restraint between a CSGA diaphragm 150, shown herein as the stetson configuration, and the gland ring 130. A lower pair of slip rings 160 and 165 provides axial restraint between the CSGA diaphragm 150 and a lower gasket 170. Another optional insert upper gasket 125, together with the lower gasket 170, provide an environmental seal for the stuffing tube interior of a swage tube 180 (also called a stuffing tube), into which the components can be inserted. The insert upper gaskets 125 enable a large size swage tube 180 to accept a thinner cable and maintain environmental integrity, thereby expanding installation flexibility.

The upper gaskets 120 and 125 have a geometric configuration reminiscent of a top-hat or stove-hat. The lower gasket 170 has a geometric configuration approximating a frustum (e.g., truncated cone). The gaskets 120, 125 and 170 are composed of rubber. The swage tube 180 narrows at a choke neck 190 before extending to shield an internal cable. The upper gaskets 125 enable a thin cable to be protected in a larger diameter swage tube 180, thereby enabling additional flexibility in cable shielding. An alternative configuration, features a pair of CSGA diaphragms 150 disposed over the upper shim 240, with the lower shim 230 and the gland ring 130 disposed over the CSGA 150. The CSGA diaphragm 150 functions equally well in either orientation.

Figure 2A:
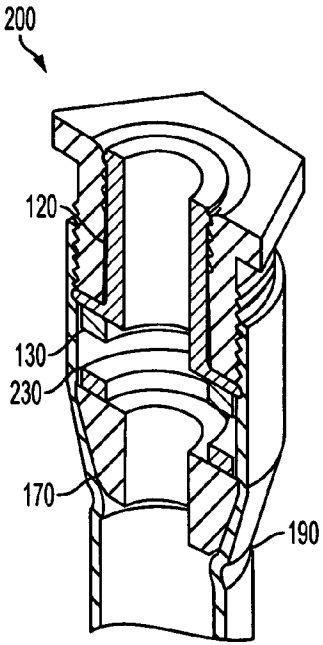
FIGS. 2A, 2B and 2C are cutaway perspective views of the exemplary ground adapter assembly.
Figure 2B:
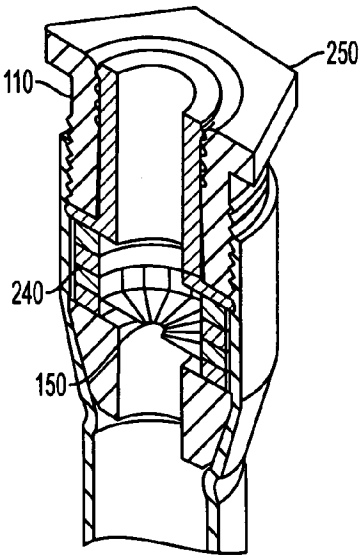
Figure 2C:
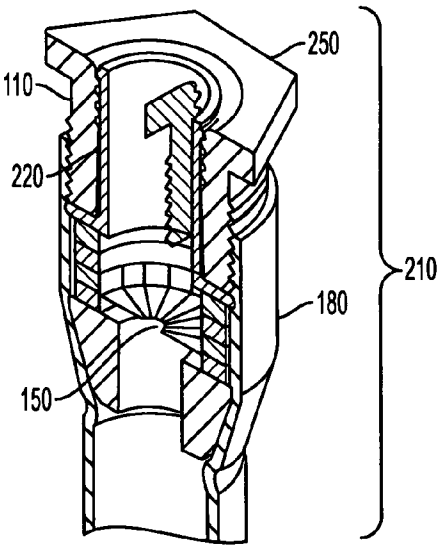

FIGS. 2A, 2B and 2C illustrate perspective cross-section views 200 of a swage tube assembly 210. The configurations shown include the upper gasket 120 and an alternative upper gasket 220 with larger inner diameter for thicker cables. The lower gasket 170 inserts into the swage tube 180 until reaching the neck 190. A lower shim 230, such as the slip rings 160 and 165 are disposed forward of the lower gasket 170.

The CSGA diaphragm 150 can be disposed over the lower shim 230. An upper shim 240 and the gland ring 130 are disposed over the CSGA diaphragm 150 (downstream of the lower gasket 170). Prior to screwing the gland nut 110 into the swage tube 180, the upper gasket 120 or 220 inserts into the gland nut 110 from its threaded end. The gland nut 110 then screws into, and its hexagonal head 250 extends axially outward from the swage tube 190.

Figure 3:
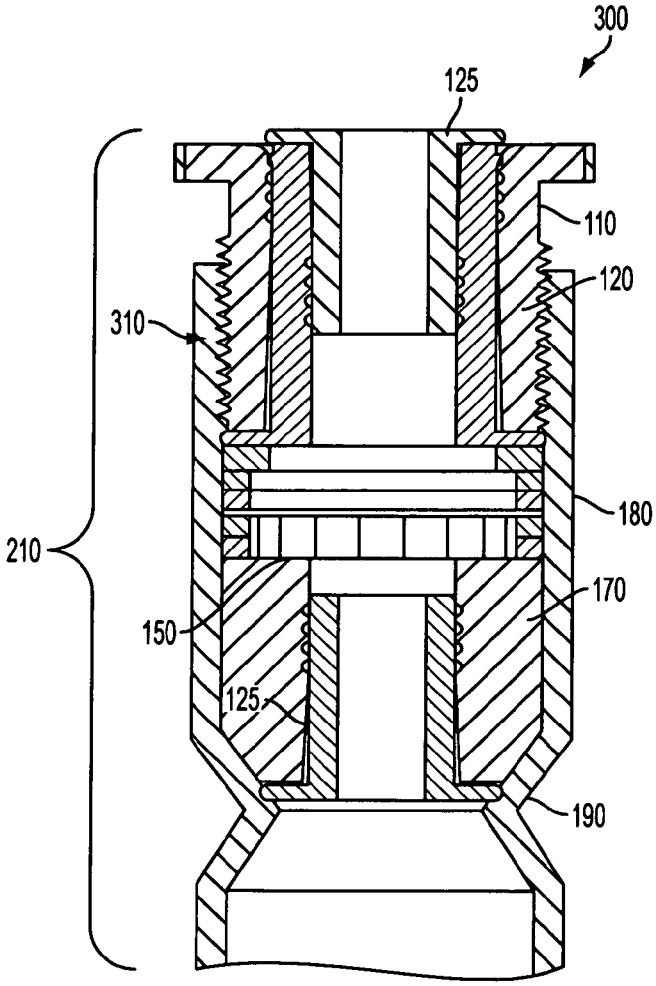
FIG. 3 is a cutaway elevation view of the exemplary ground adapter assembly.

FIG. 3 shows a cross-section elevation view 300 of the swage tube assembly 210. The gland nut 110 is shown engaging the swage tube 180 via screw threads 115 along a helical threaded interface 310. The optional upper gaskets 125 are shown inserted into the lower gasket 170 and the upper gasket 120 to receive thinner cables. The slip rings 160 and 165 radially secure the CSGA diaphragm 150, which is axially secured by the lower gasket 170 and the slip rings 140 and 145, held by the washer 130.

Figure 4A:
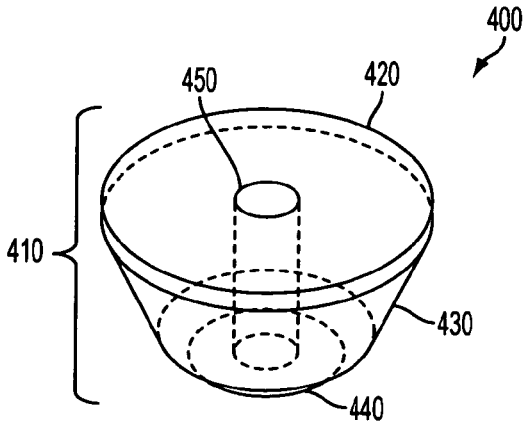
FIGS. 4A and 4B are perspective transparent views of respective B-size lower and upper gaskets.
Figure 4B:
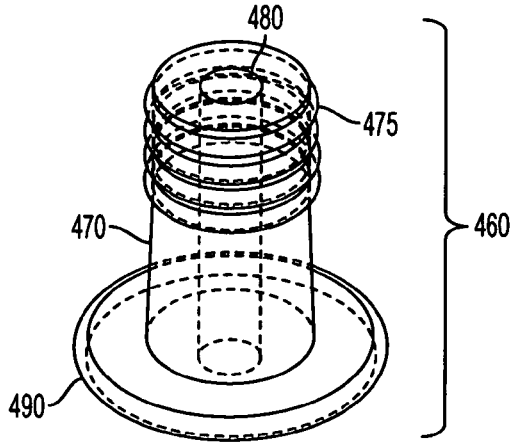

FIGS. 4A and 4B show perspective transparent views 400 of lower and upper B-size gaskets. Generically, these components correspond respectively to gaskets 170 and 120, albeit for specific dimensional configurations. The lower gasket 410 can be defined by a base 420 with beveled cylindrical rim, an axial extension 430 having geometry of a frustum (i.e., truncated cone) and a terminal head 440, which inserts into the neck 190 of the swage tube 180. The lower gasket 410 includes an axial through-hole 450 to insert a cable. The upper gasket 460, having the appearance of a top-hat can be defined by a shaft 470 optionally having radially extending ribs 475, an axial through-hole 480 and a radially extending circular brim 490.

Figures 5A, 5B, 6A, 6B, 7A, 7B, 8A, 8B:
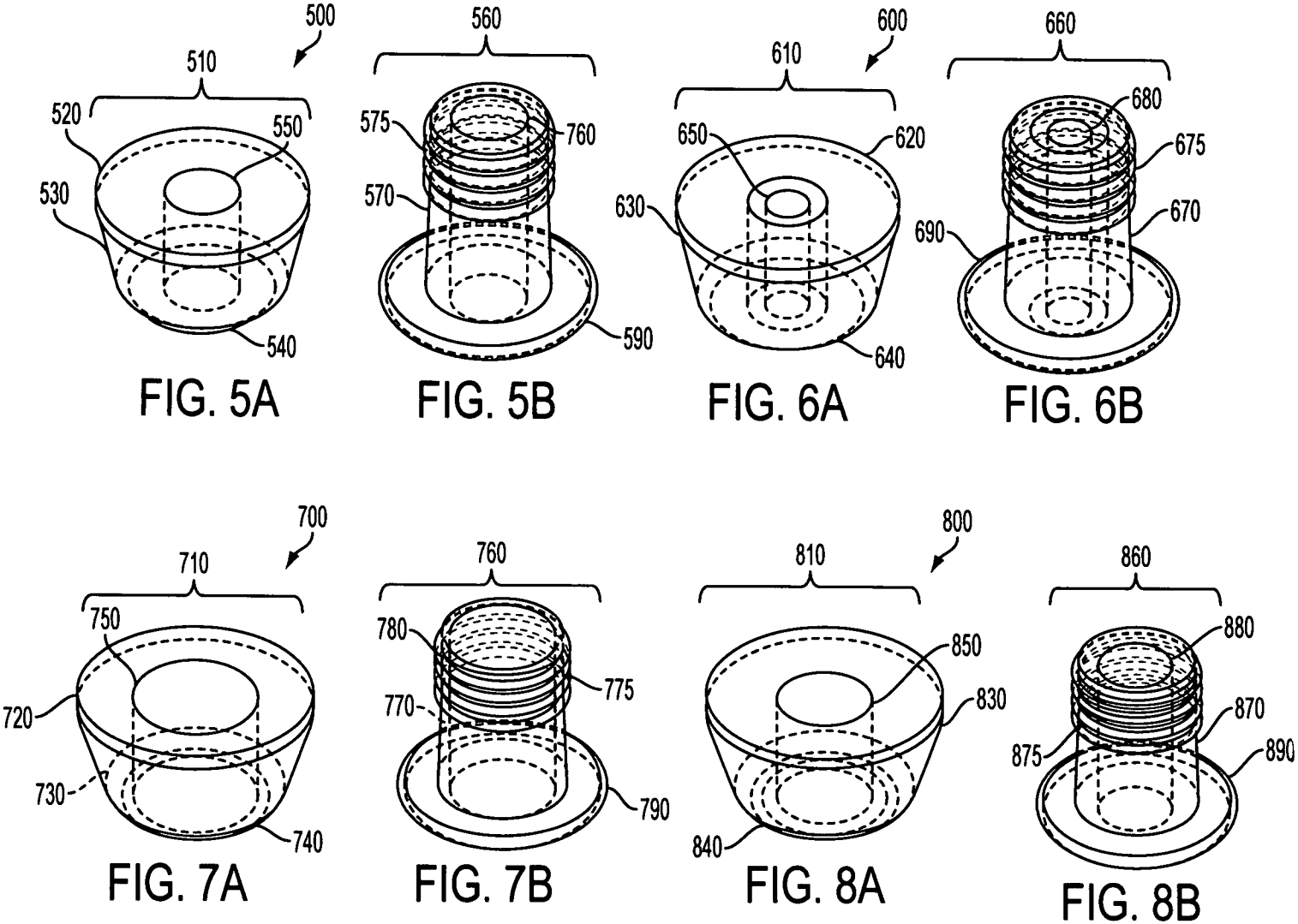
FIGS. 5A and 5B are perspective transparent views of respective wide annular C-size lower and upper gaskets.
FIGS. 6A and 6B are perspective transparent views of respective narrow annular C-size lower and upper gaskets.
FIGS. 7A and 7B are perspective transparent views of respective wide annular D-size lower and upper gaskets.
FIGS. 8A and 8B are perspective transparent views of respective narrow annular D-size lower and upper gaskets.

FIGS. 5A and 5B show perspective transparent views 500 of lower and upper C-size gaskets for larger cables. The lower gasket 510 can be defined by a base 520 with beveled cylindrical rim, a frustum extension 530 and a terminal head 540. The lower gasket 510 includes an axial through-hole 550. The upper gasket 560 can be defined by a shaft 570 optionally having radially extending ribs 575, an axial through-hole 580 and a radially extending circular brim 590.

FIGS. 6A and 6B show perspective transparent views 600 of lower and upper C-size gaskets for smaller cables. The lower gasket 610 can be defined by a base 620 with beveled cylindrical rim, a frustum extension 630 and a head 640. The lower gasket 610 includes an axial through-hole 650. The upper gasket 660 can be defined by a shaft 670 optionally having radially extending ribs 675, an axial through-hole 680 and a radially extending circular brim 690.

FIGS. 7A and 7B show perspective transparent views 700 of lower and upper D-size gaskets for larger cables. The lower gasket 710 can be defined by a base 720 with beveled cylindrical rim, a frustum extension 730 and a head 740. The lower gasket 710 includes an axial through-hole 750. The upper gasket 460 can be defined by a shaft 470 optionally having radially extending ribs 475, an axial through-hole 480 and a radially extending circular brim 490.

FIGS. 8A and 8B show perspective transparent views 800 of lower and upper D-size gaskets for smaller cables. The lower gasket 810 can be defined by a base 820 with beveled cylindrical rim, a frustum 830 and a head 840. The lower gasket 810 includes an axial through-hole 850. The upper gasket 860 can be defined by a shaft 870 having optional radially extending ribs 875, an axial through-hole 880 and a radially extending circular brim 890.

Figure 9A:
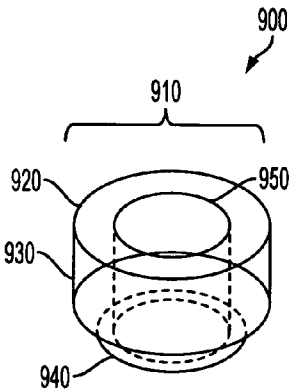
FIGS. 9A and 9B are perspective transparent views of respective standard K-size lower and upper gaskets.
Figure 9B:
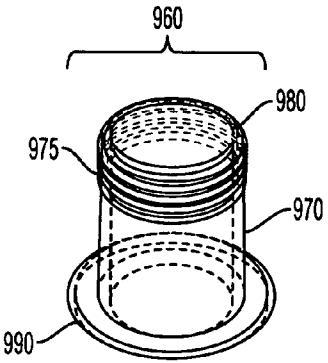

FIGS. 9A and 9B show perspective transparent views 900 of lower and upper K-size gaskets for one-inch diameter cables. The lower gasket 910 can be defined by a base 920 with beveled cylindrical rim, a frustum extension 930 and a head 940. The lower gasket 910 includes an axial through-hole 950. The upper gasket 960 can be defined by a shaft 970 optionally having radially extending ribs 975, an axial through-hole 980 and a radially extending circular brim 990.

Figure 10A:
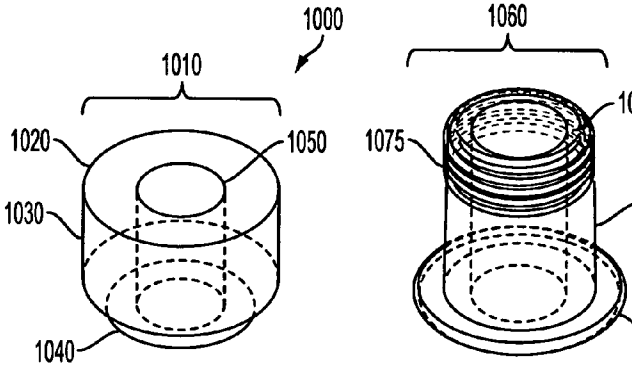
FIGS. 10A and 10B are perspective transparent views of respective K-size lower and upper gasket inserts for B-size gaskets.
Figure 10B:
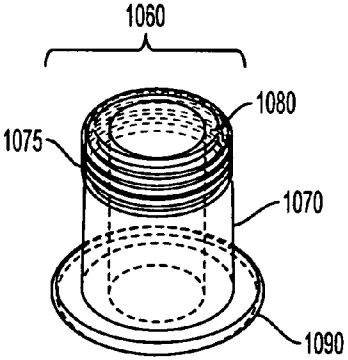

FIGS. 10A and 10B show perspective transparent views 1000 of lower and upper K-size gaskets for receiving D-size upper gaskets. The lower gasket 1010 can be defined by a base 1020 with beveled cylindrical rim, a frustum extension 1030 and a head 1040. The lower gasket 1010 includes an axial through-hole 1050. The upper gasket 1060 can be defined by a shaft 1070 optionally having radially extending ribs 1075, an axial through-hole 1080 and a radially extending circular brim 1090.

Figure 11A:
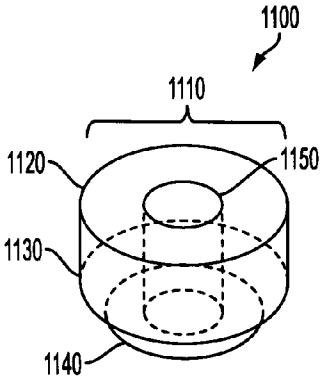
FIGS. 11A and 11B are perspective transparent views of respective K-size lower and upper gasket inserts for C-size gaskets.
Figure 11B:
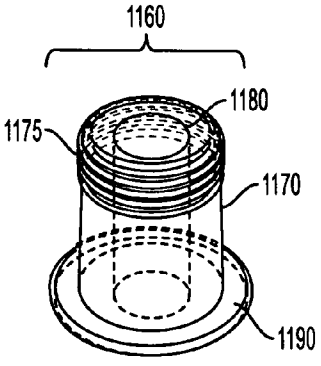

FIGS. 11A and 11B show perspective transparent views 1100 of lower and upper K-size gaskets for receiving C-size upper gaskets. The lower gasket 1110 can be defined by a base 1120 with beveled cylindrical rim, a frustum extension 1130 and a head 1140. The lower gasket 1110 includes an axial through-hole 1150. The upper gasket 1160 can be defined by a shaft 1170 optionally having radially extending ribs 1175, an axial through-hole 1180 and a radially extending circular brim 1190.

Figure 12A:
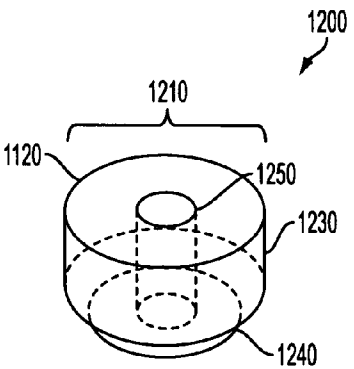
FIGS. 12A and 12B are perspective transparent views of respective K-size lower and upper gasket inserts for D-size gaskets.
Figure 12B:
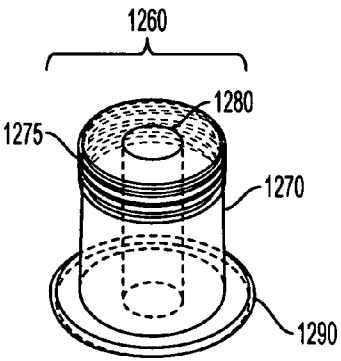

FIGS. 12A and 12B show perspective transparent views 1200 of lower and upper K-size gaskets for receiving B-size upper gaskets. The lower gasket 1210 can be defined by a base 1220 with beveled cylindrical rim, a frustum extension 1230 and a head 1240. The lower gasket 1210 includes an axial through-hole 1250. The upper gasket 1260 can be defined by a shaft 1270 optionally having radially extending ribs 1275, an axial through-hole 1280 and a radially extending circular brim 1290.

Figure 13:
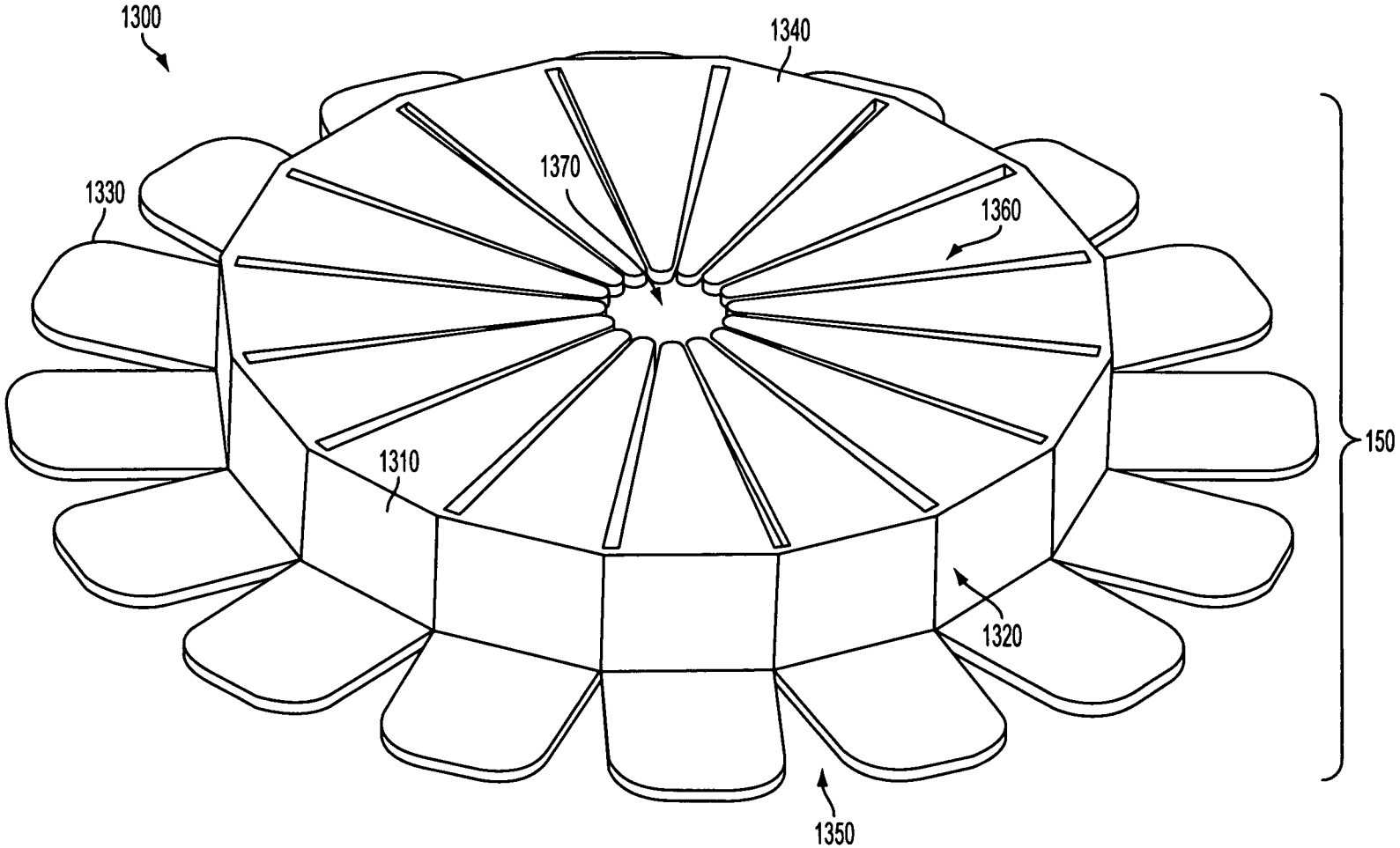
FIG. 13 is a perspective view of an exemplary "stetson" ground adapter.

FIG. 13 shows a perspective view 1300 of a conductive stetson CSGA diaphragm 150 assembly for a coaxial cable. The stetson design features an axisymmetric configuration for wrapping around a cable along its axis. The CSGA diaphragm 150 includes peripheral walls 1310 separated by folding joints 1320 disposed angularly in circular fashion. Both walls 1310 and joints 1320 extend substantially parallel to the cable axis. Outer flanges 1330 extend radially outward from the walls 1310 towards the inner periphery of the swage tube 180. Inner petals 1340 extend radially inward towards the center axis of a cable. The outer flanges 1330 are separated by gaps 1350 distributed angularly. The inner petals 1340 are separated by radial slits 1360 to form a circular gap 1370 for the cable to pass therethrough.

Figure 14:
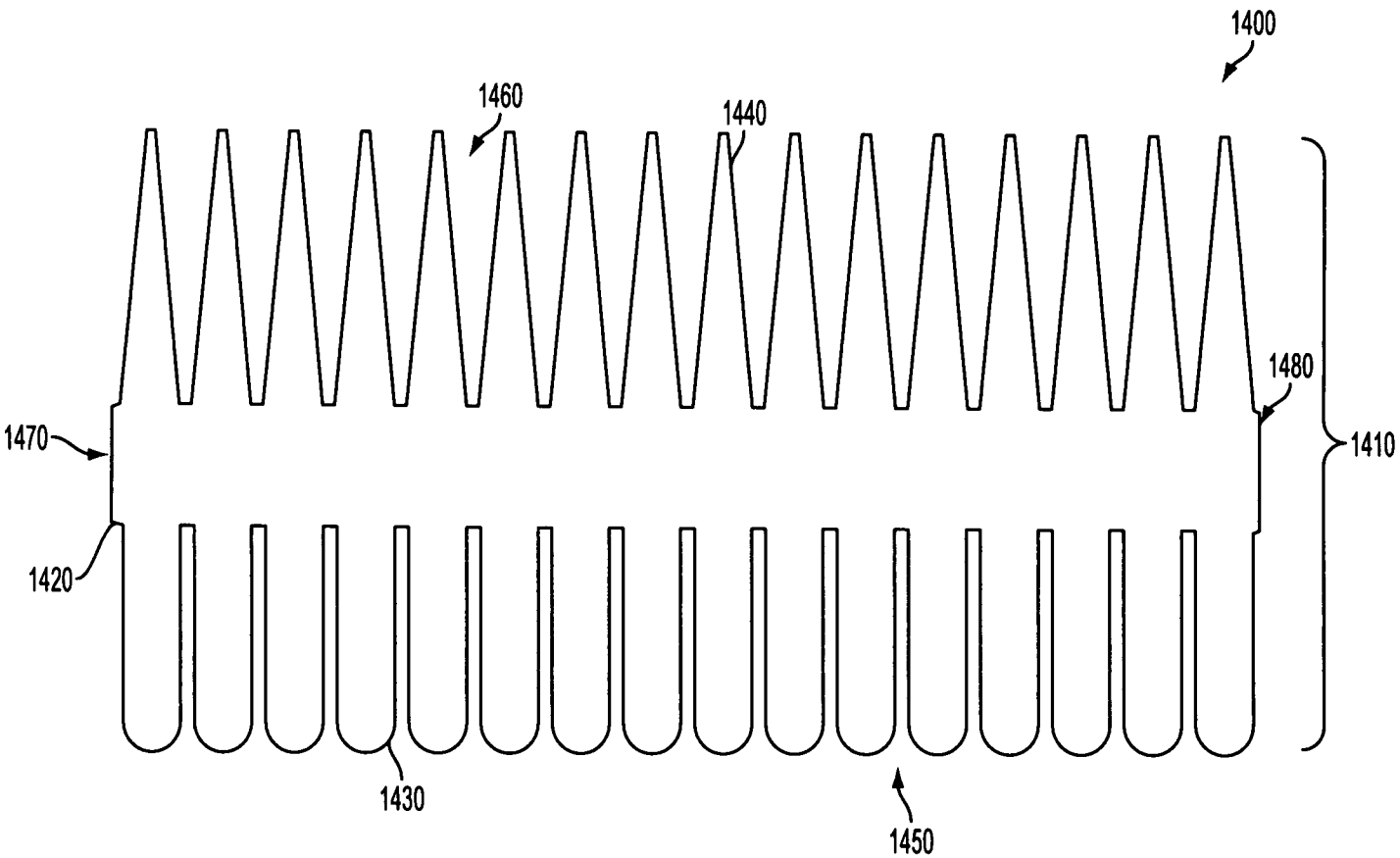
FIG. 14 is a plan view of a template for the "stetson" ground adapter.

FIG. 14 shows an elevation view 1400 of a flat strip template 1410 for the stetson-style CSGA diaphragm 150. A thin flexible band (e.g., 0.005" thickness for copper and for steel) can be cut into a continuous strip and cut to length to produce the CSGA diaphragm 150 with a regularly repeating pattern. The template 1410 includes a ribbon 1420 that longitudinally extends continuously across its length, which can be cut to a specified dimension from a continuous roll of sheet metal. The template 1410 also includes lower peripheral and upper tapered tabs 1430 and 1440 that extend laterally towards the ribbon 1420 in a regular pattern from below and above, respectively. The template 1410 should be composed of an electrically conductive and mechanically flexible (e.g., ductile) material, such as a select metals (e.g., copper, steel) or a polymer coated with an electrically conductive outer layer.

To form this pattern arrangement for the peripheral tabs 1430, the template 1410 has lower lateral incisions 1460 that repeatedly extend from the bottom peripheral edge upward towards the ribbon 1420. The peripheral tabs 1430 can be rounded or chamfered at the corners. To form the tapered tabs 1440, the template 1410 also has upper lateral incisions 1460 that repeatedly extend from the top peripheral edge downward towards the ribbon 1420. The peripheral tabs 1430 can be folded transversely outward from view 1400 to form the outer petals 1330, and the tapered tabs 1440 can be folded transversely inward from view 1400 to form the inner petals 1340 when configured to the CSGA diaphragm 150. The outer petals 1330 can be disposed adjacent to the lower gasket 170 or the gland ring 130.

The ribbon 1420 forms the walls 1310 when the template 1410 is curled so as to join the opposite axial ends 1470 and 1480 together, thereby forming a ring in which the direction of lateral incisions substantially corresponds to the cable axis. This can be accomplished, for example, by raising these ends 1470 and 1480 transversely outward from the view 1400. Thus, the template 1410 can be wrapped around a cable after folding the tapered tabs 1440 outward, folding the rounded tabs 1430 inward, and then bending and joining the ends 1470 and 1480 together, thereby forming the ring of walls 1310.

The ribbon 1420 can further be folded parallel to the incisions 1450 and 1460 to form the joints 1320 separating the walls 1310. The lower tabs 1430 become the flanges 1330 to engage the inner annular surface of the swage tube 180. The upper tabs 1440 become the petals 1340 to engage the cable. If desired, the template 1410 can be wrapped multiple times around a cable after folding the tapered tabs 1440 outward, folding the rounded tabs 1430 inward, thereby forming overlapping layers that can provide enhanced conductivity between a cable shield and the inner wall of a swage tube 180.

Figure 15:
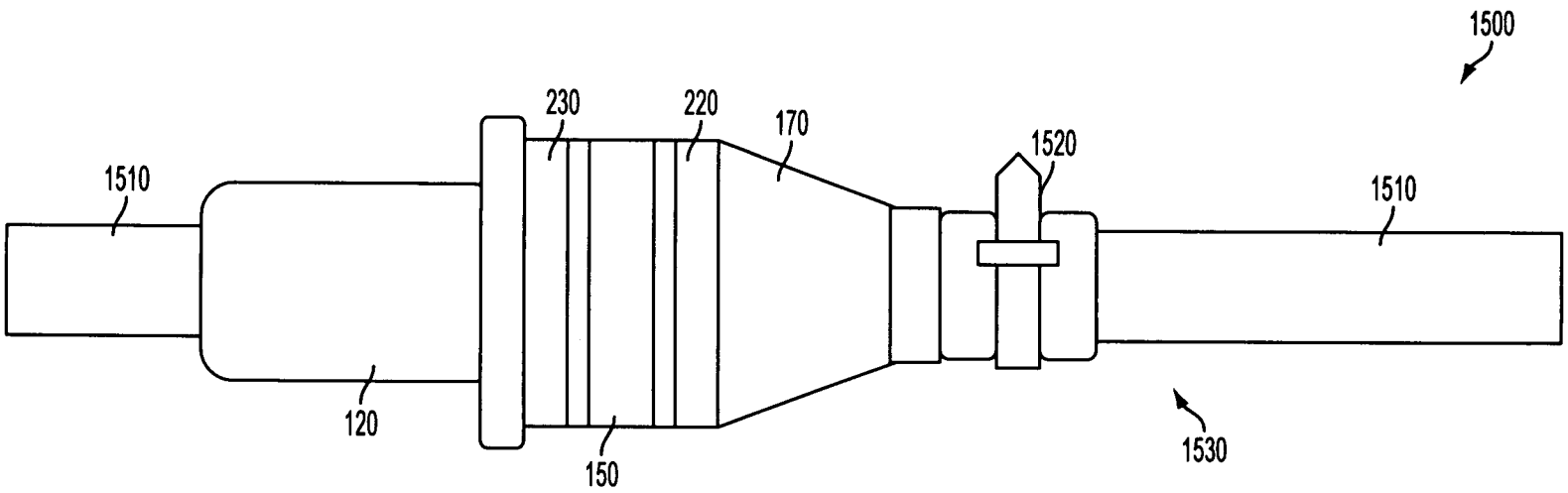
FIG. 15 is an elevation view of a cable brake clamp.

FIG. 15 shows an elevation view 1500 of an electrical cable 1510 with a CSGA diaphragm 150 installed and without the swage tube 180 being shown. The CSGA diaphragm 150 can be cut from a preformed strip 1410 to wrap around the cable 1510. Upon installation, the CSGA diaphragm 150 can be secured by the washers 230 and 240. Adhesive tape 1520 can be wrapped around the cable 1510 for securing to the lower gasket 170. The cable 1510 can also be secured by a cable clamp 1530, such as a plastic or metal zip-tie.

The commercial potential for the ground shield adapter described within broad and global in nature. The designs can be used for commercial as well as naval ship construction. Due to the inherent design tolerance for either SAE or metric dimensions for swage tubes 180, the design can be utilized for both domestic and foreign ship construction. Although designed with maritime applications in mind, the designs can also be utilized for general construction practices where swage tubes or breach type fittings might be required for facility cable penetrations that require grounding, stabilization, or weather sealing.

The United States Navy utilizes hundreds of topside components that require electrical power or signal connections to systems internal to the ship via cable. Because of the complex and system hostile EM environment the connecting cables must be protected from unwanted EM coupling to the signal or power cable. The cables therefore are protected from the EM environment by a conductive cable shield grounded via a CSGA to the ship's bulkhead.

Current CSGA technologies utilized by the Navy are difficult to manufacture due to machining, difficult to install, repair and replace due to design characteristics, have relatively short service life due to poor environmental design, and are very expensive (approximately $300.00 per unit in quantity). The Navy also currently purchases CSGAs in multiple sizes due to the conventional CSGAs inability to adapt to multiple swage tube sizes or cable diameters. This significantly increases acquisition, logistics and design costs. The strategic goal of the proposed design is to provide the Navy a cost efficient technology that can significantly reduce total ownership costs via acquisition maintenance and logistics across the fleet.

The exemplary embodiments utilize relatively few parts. Common components include environmental seals that also perform as stabilizing structural components for cable centering and conductive spacers that perform diaphragm deformation control functions. The grounding diaphragm or CSGA diaphragm 150 itself is a cut stamped component made out of conductive sheeting.

The sheeting can be any useable conductive material depending on application such as brass, copper, stainless steel, aluminum or carbon impregnated sheeting. The required thickness of the sheeting depends on the design. The exemplary designs also utilize all components of the stuffing tube assembly. This includes the brass gland nut used as an integrating component and currently unused for shielded cable applications due to design characteristics of conventionally available CSGA designs. For conventional replacement operations of the CSGA assembly, the gland nut 110 may be discarded, resulting in waste higher incurred costs to the Navy.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An adapter for electrically connecting an interior surface of a conduit and an external surface of a cable, said adapter comprising:

a flat strip extending longitudinally from first to second ends with first and second transverse edges and composed of an electrically conductive and mechanically flexible material, said strip including:

a longitudinal ribbon from said first to second ends, wherein said ribbon forms a ring for wrapping around the cable by curling said first and second ends together in a direction transverse to said sheet, and a plurality of first and second incisions from said transverse edges towards said ribbon, said incisions being disposed at respective intervals that correspond to a longitudinally regular pattern, wherein said first incisions form tapering tabs for bending in said direction transverse to said sheet to produce petals that extend radially inward from said ring to engage the cable, and said second incisions form peripheral tabs for bending in an opposite direction transverse to said sheet to produce flanges that extend radially outward from said ring to engage the conduit.

2. The adapter according to claim 1, wherein said ribbon includes a plurality of folds between said first and second incisions to facilitate curving and maintaining said ring.

3. The adapter according to claim 1, wherein said peripheral tabs have rounded corners.

4. The adapter according to claim 1, wherein said material is composed of copper.

5. The adapter according to claim 1, wherein said material is composed of steel.

6. The adapter according to claim 1, wherein said strip is cut from a continuous roll of said material.

7. An electrical conduit ground assembly for electrically and environmentally shielding an electric cable within a swage tube that includes a neck connecting to a conduit, a threaded opening, and an annular conduit therebetween, said assembly comprising:

a first annular seal for insertion downstream through said opening and disposal at said neck, said first seal having frustum and cylinder portions;

a first annular washer for insertion downstream through said opening and disposal on said first seal;

a slip-ring for insertion downstream through said opening and disposal on said first washer;

a second annular washer for insertion downstream through said opening and disposal on said slip-ring;

a gland nut for screwing into said opening;

a second annular seal for insertion of an end upstream into said gland nut, said second seal having an annular shaft and a circular brim that radially extends from an opposite end; and an annular ground adapter for electrically connecting the cable and the annular conduit, said adapter being insertable between said first and second washers and securable by said slip-ring with the cable installed in the swage tube.

8. The assembly according to claim 7, wherein for assembly, the cable inserts into the swage tube, said first seal inserts from said frustum portion through the cable for disposal at the neck, said first washer inserts through the cable for disposal at said cylinder portion, said slip-ring inserts through said cable, said second washer inserts through said cable, said second seal inserts through said cable from said rim and inserts into said gland nut from said shaft, said ground adapter wraps around the cable between said first washer and said slip-ring;

said slip-ring overlays said ground adapter in position to form an adapter assembly, said adapter assembly inserts into the conduit on said first washer;

said second washer disposes at said adapter assembly, and said gland nut screws into said opening.

9. The assembly according to claim 7, further including a gland ring for disposal between said brim and said second washer.

10. The assembly according to claim 7, further including third and fourth annular seals for respectively inserting into said first and second seals, said third and fourth seals each having an annular shaft and a circular brim that radially extends from an opposite end.

* * * * *